United States Patent [19]

Kato

[11] Patent Number: 4,778,953

[45] Date of Patent: Oct. 18, 1988

[54] SEALED ROTARY SWITCH

[75] Inventor: Yuichi Kato, Yokohama, Japan

[73] Assignee: Ohi Seisakusho Co., Ltd., Yokohama, Japan

[21] Appl. No.: 79,394

[22] Filed: Jul. 30, 1987

[30] Foreign Application Priority Data

Aug. 4, 1986 [JP] Japan ..... 61-118904[U]
Oct. 15, 1986 [JP] Japan ..... 61-156744[U]

[51] Int. Cl.[4] ..... H01H 21/08; H01H 21/62

[52] U.S. Cl. ..... 200/11 G; 200/155 R; 200/302.1

[58] Field of Search ..... 200/11 R, 11 A, 11 D, 200/11 DA, 11 E, 11 EA, 11 G, 11 J, 11 K, 11 TW, 302.1, 302.3, 155 R, 302.2

[56] References Cited

U.S. PATENT DOCUMENTS

| | | | |
|---|---|---|---|
| 2,724,024 | 11/1955 | Durant et al. | 200/11 G |
| 2,908,777 | 10/1959 | Brown | 200/11 J |
| 3,248,489 | 4/1966 | Korrell et al. | 200/302.1 X |
| 3,300,594 | 1/1967 | Paine et al. | 200/11 G |
| 3,371,167 | 2/1968 | Soulakis, Jr. | 200/11 G |
| 3,470,333 | 9/1969 | Schneider et al. | 200/11 G |
| 4,200,773 | 4/1980 | Komatsu et al. | 200/11 G X |

FOREIGN PATENT DOCUMENTS

| | | |
|---|---|---|
| 087805 | 7/1983 | European Pat. Off. . |
| 1100014 | 6/1965 | United Kingdom . |
| 1155373 | 9/1966 | United Kingdom . |
| 1282925 | 8/1969 | United Kingdom . |
| 1359301 | 11/1970 | United Kingdom . |
| 1425768 | 5/1973 | United Kingdom . |

*Primary Examiner*—J. R. Scott

*Attorney, Agent, or Firm*—Foley & Lardner, Schwartz, Jeffery, Schwaab, Mack, Blumenthal & Evans

[57] ABSTRACT

Herein disclosed is a sealed rotary switch which is reliably operable even in a cold winter. The switch comprises a case having a bottomed cylindrical bore, a pair of stationary contacts exposed to the cylinderical bore, a rotatable contact rotatably received in the cylindrical bore of the case so as to be contactable with the stationary contacts, a shaft member having one end portion detachably connected to the rotatable contact and the other end portion projected outwardly from the cylindrical bore of the case, the one end portion being rotatably supported on the bottom of the bore, and a circular cover member having a central bore, the cover member being sealingly and detachably received in a mouth portion of the bore of the case while sealingly receiving the other end portion of the shaft member in the central bore thereof.

19 Claims, 5 Drawing Sheets

SEALED ROTARY SWITCH

BACKGROUND OF THE INVENTION

1. Field of the Invention

The present invention relates in general to a rotary switch and more particularly to a sealed rotary switch which is to be used in a severe environment.

2. Description of the Prior Art

Hitherto, various kinds of rotary switches have been proposed and put into practical use particularly in the fields of motor vehicles, construction machinery and other industrial machines.

Some of the conventional rotary switches are of a type which uses a micro-switch as means for producing information signals, viz., ON-OFF signals. As is known, the micro-switch is of a small and highly sensitive switch in which minute and feeble motion establishes contact. However, due to this inherency, the micro-switch sometimes suffers from malfunction particularly when it is used in a very cold environment.

In order to clarify this undesired matter, one of the conventional rotary switches of the above-mentioned type will be outlined with reference to FIG. 10.

The conventional rotary switch "B" illustrated in the drawing comprises a micro-switch "A" having an actuator button "E" and an actuator arm "D", and a rotary cam "C" having a shaped periphery to which a leading end of the actuator arm "D" slidably contacts. The actuator button "E" is biased outwardly by a suitable biasing means housed in the micro-switch "A", so that the leading end of the actuator arm "D" is pressed against the periphery of the rotary cam "C". Upon rotation of the rotary cam "C" about its axis, the leading end of the actuator arm "D" slides on and along the periphery of the rotary cam "C" while intermittently pushing the actuator button "E" in accordance with the shape of the rotary cam "C". Usually, the biasing force applied to the actuator button "E" by the biasing means is set to such a relatively small degree as to barely push back the actuator arm "D" when the latter comes to a depressed OFF position of the periphery of the rotary cam "C". Thus, when, for example in winter, some parts of the micro-switch "A" are iced even weakly, it tends to occur that the actuator button "E" fails to closely follow the swinging movement of the actuator arm "D" thereby causing malfunction of the micro-switch "A", viz., malfunction of the rotary switch "B".

SUMMARY OF THE INVENTION

It is therefore an object of the present invention to provide a sealed rotary switch which is free of the above-mentioned drawback.

It is another object of the present invention to provide a sealed rotary switch which is tough and simple in construction.

It is still another object of the present invention to provide a sealed rotary switch which can be manufactured at reduced cost.

According to the present invention, there is provided a rotary switch which comprises a case constructed of insulating material and having a bottomed cylindrical bore formed therein; a pair of conductive plates embedded in the case, each plate having one end exposed to the cylindrical bore to form a stationary contact and the other end exposed to the outside of the case to form a terminal; a rotatable contact having two contact points formed thereon, the rotatable contact being rotatably received in the cylindrical bore in such a manner that the contact points are brought into contact with the stationary contacts of the conductive plates when the rotatable contact assumes a given angular position relative to the case; a first structure having one end portion detachably connected to a center of the rotatable contact and the other end portion projected outward from the cylindrical bore of the case, the one end portion being rotatably supported on the bottom of the cylindrical bore of the case; and a circular second structure having a central bore, the second structure being sealingly and detachably received in a mouth portion of the cylindrical bore of the case while sealingly receiving the other end portion of the first structure in the central bore thereof.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
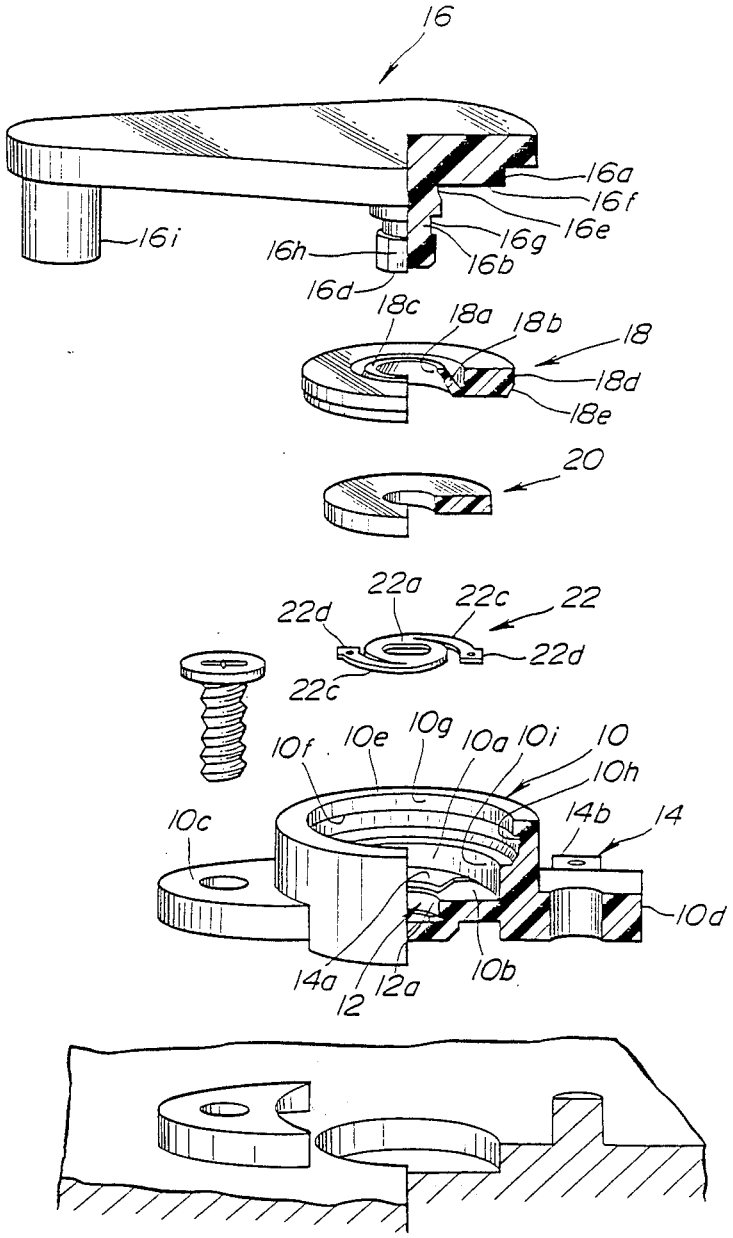
FIG. 1 is an exploded view of a sealed rotary switch of a first embodiment of the present invention.
Figure 2:
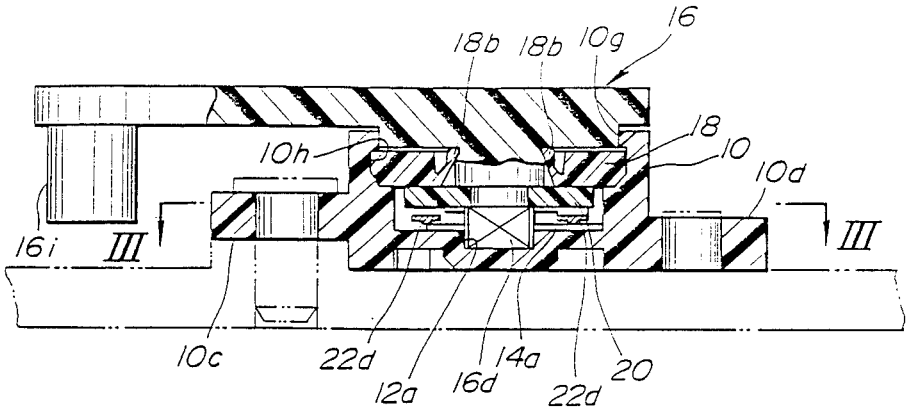
FIG. 2 is a vertically sectional but partially side view of the rotary switch in assembled condition.
Figure 3:
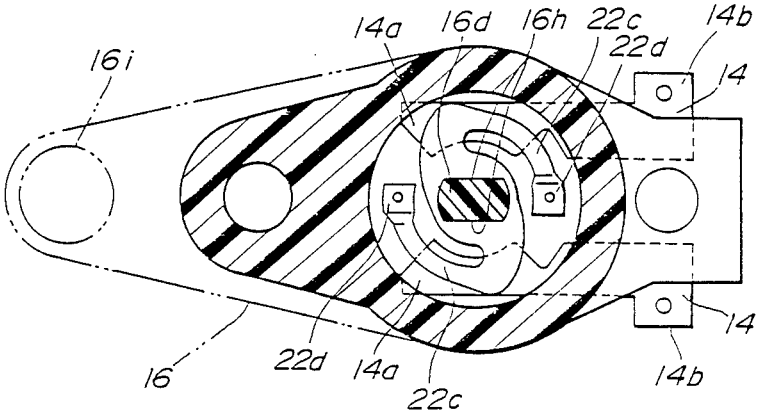
FIG. 3 is a sectional view taken along the line III—III of FIG. 2.

Referring to FIGS. 1 to 3, there is shown a sealed rotary switch of a first embodiment of the present invention.

As will be seen from FIG. 1, the rotary switch comprises a case 10 constructed of an insulating material, such as plastics or the like, which has a cylindrical bottomed bore 10*a*. The circular bottom is denoted by numeral 10*b*, which has at its center a bearing portion 12, viz., a small circular recess 12*a*. The case 10 has oppositely extending lug portions 10*c* and 10*d* integrated with the major portion of the case 10. Near the mouth of the bore 10*a*, there is defined an annular groove 10*h* which leaves at the entrance an inwardly projected annular ridge 10*e*. Denoted by numeral 10*f* is an annular step defined between the groove 10*h* and the ridge 10*e*, and denoted by numeral 10*g* is a cylindrical inner surface of the ridge 10*e*. As will be understood from FIGS. 1 and 3, a pair of conductive plates 14 and 14 are integrally embedded in the case 10 having their one leading ends, viz., stationary contacts 14*a* and 14*a*, exposed to the bore 10*a* and put on diametrically opposed portions of the bottom 10*b* of the bore 10*a*. The other ends 14*b* and 14*b* of the conductive plates 14 and 14 are exposed to the outside of the case 10 to form terminals. It is to be noted that the conductive plates 14 and 14 have been set in a mold as inserts upon molding of the case 10.

An arm member 16 constructed of plastics is rotatably connected to the case 10 in a manner as will be described in the following.

As is seen from FIG. 1, the arm member 16 comprises a diametrically larger base portion and a shank portion extending radially from the base portion. The base portion includes a circular stepped portion 16*a* and a shaft portion 16*b* coaxial with the circular stepped portion 16*a*. Upon coupling, the circular stepped portion 16*a* is coaxially but spacedly received in the annular ridge 10*e* of the case 10, and the shaft portion 16*b* is projected into the bore 10*a* of the case 10 having its leading end 16*d* beared by the bearing portion 12 of the case 10. Thus, the arm member 16 is rotatable about the axis of the shaft portion 16*b* relative to the case 10.

The shaft portion 16*b* of the arm member 16 is formed at its root portion with an annular groove 16*e* to which an annular inner lip 18*b* of an annular sealing member 18 is sealingly engaged. The sealing member 18 is thus constructed of a flexible plastics, such as polyacetal, 6—6 nylon (trade name) or the like and has the annular inner lip 18*b* shaped conical. Denoted by 18*a* and 18*c* are an inner conical surface of the lip 18*b* and an annular top of the same, respectively. The annular sealing member 18 is so sized as to be snugly and sealingly put into the annular groove 10*h* of the case 10. That is, upon coupling, the outer cylindrical surface 18*d* of the sealing member 18 is sealingly engaged with the bottom of the groove 10*h*. Furthermore, the annular sealing member 18 is formed at its outer surface with a tapered end portion 18*e* for facilitating insertion thereof into the annular groove 10*h* of the case 10.

The shaft portion 16*b* of the arm member 16 is further formed at the position between the annular groove 16*e* and the leading end 16*d* with another annular groove 16*g* to which an annular washer 20 of resilient plastics is engaged for holding the annular sealing member 18 on the shaft portion 16*b* of the arm member 16.

As is seen from FIG. 1, the leading end 16*d* of the shaft portion 16*b* of the arm member 16 is formed with parallel flat surface 16*h* thereby to have a generally rectangular prism shape as may be understood from FIG. 3. Engaged with this rectangular prism-shaped end portion to be driven by the same is a rotatable contact 22 which is constructed of highly conductive and resilient metal plate. Preferably, the rotatable contact 22 is press-formed. For this engagement, the rotatable contact 22 has at its center a generally rectangular opening 22*a* into which the rectangular end portion of the shaft portion 16*b* is inserted. The rotatable contact 22 comprises two generally J-shaped arms 22*c* and 22*c* which extend outwardly from diametrically opposed portions of a central major portion of the rotatable contact 22. Each arm 22*c* has a contact point 22*d* at the leading end. Under a non-stressed condition wherein no external force is applied thereto, the rotatable contact 22 is axially expanded somewhat, so that upon assembly, the contact points 22*d* and 22*d* of the rotatable contact 22 are pressed against the bottom 10*b* or the stationary contacts 14*a* and 14*a* thereon with the center major portion of the contact 22 pressed against the annular washer 20. With this, the annular washer 20 is held on the shaft portion 16*b* of the arm member 16 without play.

Figure 5:
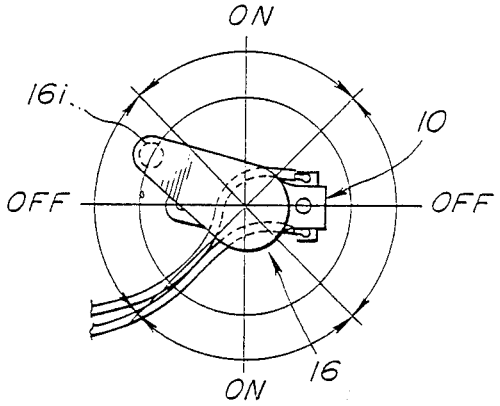
FIG. 5 is a plan view of the rotary switch, depicting the rotation angle of the arm member for achieving ON or OFF condition.

Thus, it will be appreciated that rotation of the arm member 16 about the axis of the shaft portion 16*b* induces sliding movements of the contact points 22*d* and 22*d* of the rotatable contact 22 on and along an annular truck which comprises a part of the bottom 10*b* of the case 10 and a part of the stationary contacts 14*a* and 14*a* of the conductive plates 14 and 14. This means that the rotation of the arm member 16 induces repeatedly ON-state wherein the contact points 22*d* and 22*d* of the rotatable contact 22 are in contact with the mutually spaced stationary contacts 14*a* and 14*a* of the conductive plates 14 and 14, and OFF-state wherein the contact points 22*d* and 22*d* are out of contact with the stationary contacts 14*a* and 14*a*. That is, ON and OFF states of the rotary switch are repeatedly carried out during rotation of the arm member 16. This will be understood from FIG. 5 which shows four angular ranges of the arm member 16 for allowing the rotary switch to assume ON and OFF states.

In the following, assembling step of the rotary switch will be described with reference to the drawings.

First, the annular sealing member 18 is thrusted onto the shaft portion 16*b* of the arm member 16 having the annular top 18*c* of the lip 18*b* thereof sealingly received in the annular groove 16*e* of the shaft portion 16*b*. Then, the annular washer 20 is thrusted onto the shaft portion and brought into latched engagement with the annular groove 16*g* of the shaft portion 16*b*, and the rotatable contact 22 is latchedly engaged with the rectangular-prism-shaped end portion 16*d* of the shaft portion 16*b* of the arm member 16. The engagement of the rotatable contact 22 with the shaft portion 16*b* should be made as tight as possible.

Then, the parts thus assembled are put into the case 10. This step is made in a snap action manner because of latched engagement of the annular sealing member 18 with the annular groove 10*h* of the case 10. Furthermore, because of provision of the small circular recess 12*a*, viz., bearing portion 12 of the case 10, by which the leading end 16*d* of the shaft portion 16*b* of the arm member 16 is to be beared, positioning of the shaft portion 16*b* in the case 10 is very facilitated.

Figure 4:
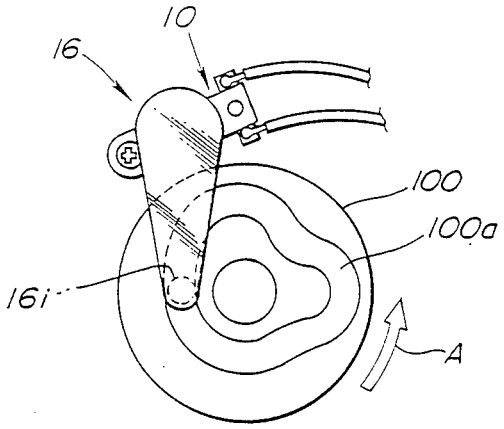
FIG. 4 is a plan view of the rotary switch which is applied to a practical use.

Referring to FIG. 4, there is shown the rotary switch which is under practical use. That is, denoted by numeral 100 is a rotating circular plate which is formed at its major flat portion with a winding endless groove 100*a*. Slidably engaged with the groove 100*a* is a guide pin 16*i* which is fixed to the leading end of the arm member 16 of the rotary switch. With this arrangement, rotation of the circular plate 100 in the direction of the arrow "A" induces a swingable movement of the arm member 16 about the axis of the shaft portion 16*b* of the same relative to the case 10. Thus, ON and OFF states are repeatedly carried out in the rotary switch during rotation of the circular plate 100. Preferably, the guide pin 16*i* is rotatably held by the arm member 16 for smoothing the movement of the guide pin 16*i* along the groove 100*a* of the circular plate 100.

In the following, modifications of the first embodiment will be itemized.

If desired, the stationary contacts 14*a* and 14*a* may be put on the cylnidrical inner wall 10*i* (see FIG. 1) of the bore 10*a* of the case 10. Of course, in this case, the contact points 22*d* and 22*d* are shaped to be pressed againt the cylndrical inner wall 10*i*.

Furthermore, the rotatable contact 22 may be formed with a flanged center opening as a substitute for the above-mentioned opening 22*a* (see FIG. 1). In this case, the flange of the opening can act as the annular washer 20.

Furthermore, if desired, the bore 10*a* of the case 10 may be filled with silicone grease or the like. In this case, the undesired freezing of the parts in the case 10 is completely avoided.

Referring to FIGS. 6 to 9, there is shown a sealed rotary switch of a second embodiment of the present invention.

Figure 6:
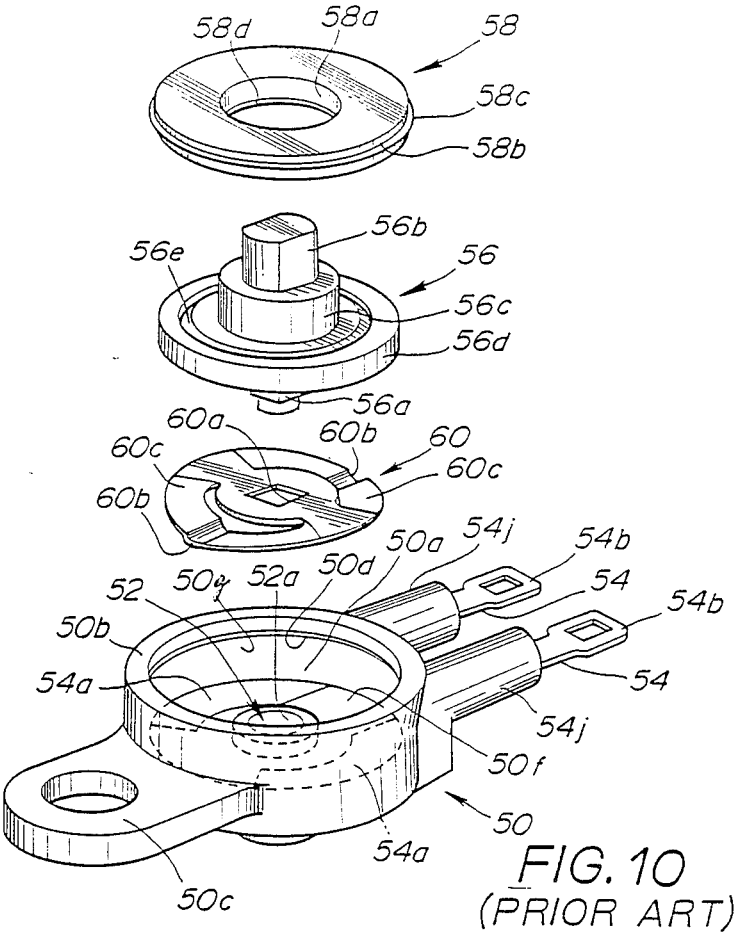
FIG. 6 is an exploded view of a sealed rotary switch of a second embodiment of the present invention.
Figure 10:
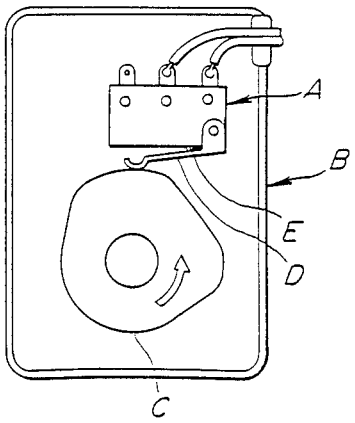
FIG. 10 (PRIOR ART)
FIG. 10 is a front view of a conventional rotary switch of a type using a micro-switch.

As will be best seen from FIG. 6, the rotary switch of this embodiment comprises a case 50 constructed of an insulating material, such as plastics or the like, which has a cylindrical bottomed bore 50*a*. The circular bottom is denoted by numeral 50*f*, which has at its center a bearing portion 52 a small rimmed circular recess 52*a*. The case 50 has a lug portion 50*c* integrated therewith. Unlike the case of the aforementioned first embodiment, the bore 50*a* is of a stepless cylindrical bore. The stepless cylindrical inner surface of the bore 50*a* is denoted by numeral 50*g*. Near the mouth of the bore 50*a*, there is defined an annular groove 50*d*. Denoted by numeral 50*b* is an annular ridge which defines the entrance of the bore 50*a* of the case 50. As will be understood from FIGS. 6 and 8, a pair of conductive plates 54 and 54 are integrally embedded in the case 50 having their one leading ends, viz., stationary contacts 54*a* and 54*a*, exposed to the bore 50*a* and put on diametrically opposed portions of the bottom 59*f* of the bore 50*a*. The other ends 54*b* and 54*b* of the conductive plates 54 and 54 are exposed to the outside of the case 50 to form terminals. Denoted by numerals 54*j* and 54*j* are leg portions of the case 50 through which the conductive plates 54 and 54 extend. Similar to the case of the afore-mentioned first embodiment, the condutive plates 54 and 54 have been set in a mold as inserts upon molding of the case 50.

A spinning top-like rotatable member 56 constructed of plastics is rotatably received in the case 50. As is seen from FIG. 6, the rotatable member 56 comprises a shaft portion 54*a* which has a generally right prism-shaped lower end rotatably received in the rimmed circular recess 52*a* of the case 50 and has a generally rectangular prism-shaped upper end 56*b* projected outwardly from the bore 50*a* of the case 50. As may be seen from FIG. 7, the upper end 56*b* is fixed to an arm member 57 which serves like the arm member 16 (see FIG. 1) of the aforementioned first embodiment. That is, a swinging movement of the arm member 57 induces the same movement of the shaft portion 56*a* in the case 50. Smaller and larger circular portions 56*c* and 56*d* are integrally and coaxially formed about the shaft portion 56*a*.

As may be seen from FIG. 6, engaged with the angular lower portion of the shaft portion 56*a* is a circular rotatable contact 60 made of a resilient metal plate. For this engagement, the rotatable contact 60 is formed with a square center opening 60*a* in which the angular lower portion of the shaft portion 56*a* is snugly received. Thus, the rotatable member 56 and the rotatable contact 60 rotate together. As is seen from the drawing, the rotatable contact 60 comprises a pair of arcuate wing portions 60*c* and 60*c* which are integrally connected with each other to form an annular peripheral portion. Jointed portions of the arcuate wing portions 60*c* and 60*c* are projected downward to form respective contact points 60*b* and 60*b*. Under nonstressed condition, the rotatable contact 60 is axially expanded having the contact points 60*b* and 60*b* mostly projected outwardly. Thus, upon assembly, the contact points 60*b* and 60*b* of the rotatable contact 60 are pressed against the bottom 50*f* or the stationary contacts 54*a* and 54*a* thereon with the central major portion of the rotatable contact 60 pressed against a lower flat portion of the larger circular portion 56*d* of the rotatable member 56.

Denoted by numeral 58 is a circular cover member made of plastics. The cover member 58 is formed with a circular center opening 58*a* the diameter of which is slightly larger than that of the smaller circular portion 56*c* of the rotatable member 56. The cover member 58 is further formed about the outer cylindrical surface 58*b* thereof with a concentric annular ridge 58*c* which is to be snugly received in the annular groove 50*d* of the case 50. That is, the cover member 58 is so sized as to be snugly and sealingly put into the mouth portion of the bore 50*a* of the case 50.

In the following, assembling steps of the rotary switch of the second embodiment will be described with reference to FIGS. 6 to 9.

First, the circular rotatable contact 60 is thrusted onto the shaft portion 56*a* of the rotatable member 56, and then the two parts thus assembled are put into the case 50 having the lower end of the shaft portion 56*a* of the rotatable member 56 rotatably received in the rimmed circular recess 52*a* of the case 50. Then, the cover member 58 is thrusted into the mouth of the bore 50*a* while receiving the upper end 56*b* of the shaft portion 56*a* of the rotatable member 56 into the circular center opening 58*a* thereof. This is accomplished when the annular ridge 58*c* of the cover member 58 is properly engaged with the annular groove 50*d* of the case 50.

Figure 7:
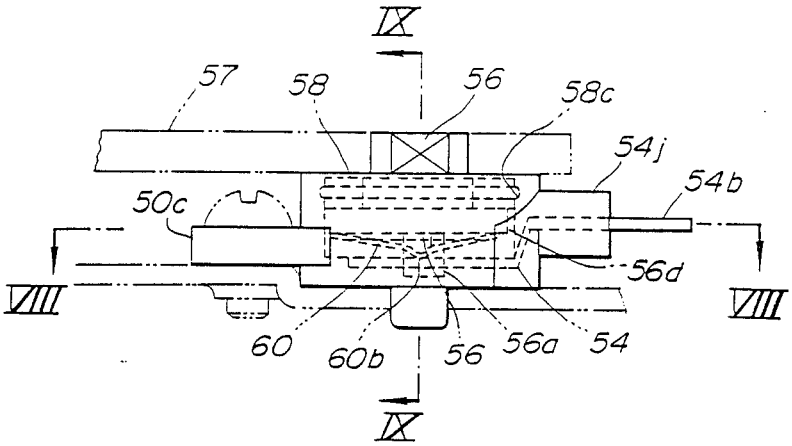
FIG. 7 is a front view of the rotary switch of the second embodiment in assembled condition.
Figure 8:
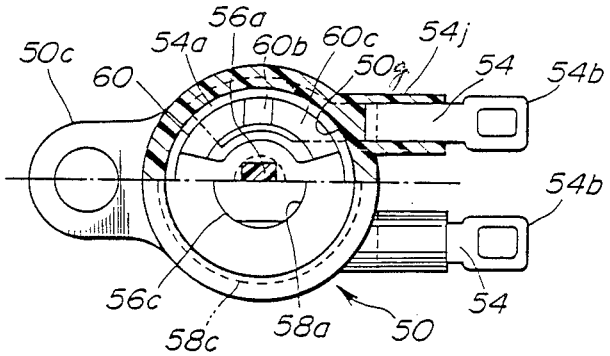
FIG. 8 is a partially plan sectional view taken along the line VIII—VIII of FIG. 7.
Figure 9:
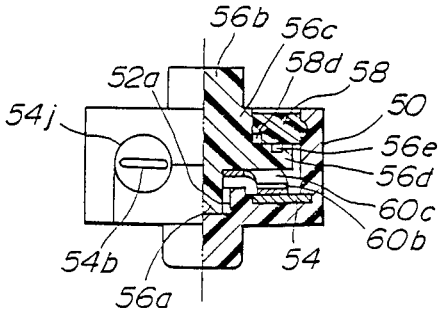
FIG. 9 is a partially side sectional view taken along the line IX—IX of FIG. 7.

In practical use, as will be understood from FIG. 7, the upper end 56*b* of the shaft portion 56*a* is fixed to the arm member 57 to be rotated about the axis thereof. Similar to the case of the afore-mentioned first embodiment, the rotation or swingable movement of the shaft portion 56*a* induces sliding movement of the contact points 60*b* and 60*b* of the rotatable contact 60 on and along a given annular track which comprises a part of the bottom 50*f* of the case 50 and a part of the stationary contacts 54*a* and 54*a* of the conductive plates 14 and 14. This means that the rotation or swinging movement of the shaft portion 56*a* induces repeatedly ON and OFF states of the rotary switch.

Modifications of the second embodiment will be itemized in the following.

If desired, the shaft portion 56*a* of the rotatable member 56 may be formed with a spherically projected lower end. In this case, rotation of the rotatable member 56 relative to the case 50 is much more smoothly achieved because of reduction in friction therebetween.

Furthermore, the bore 50*a* of the case 50 may be filled with silicone grease in order to completely protect the rotary switch from freezing trouble in winter.

Furthermore, if desired, the larger circular portion 56*d* of the rotatable member 56 and the circular cover member 58 may be formed with respective grooves 56*e* and 58*d* (see FIG. 6) for receiving therein silicone grease or the like.

As will be understood from the foregoing description, in accordance with the present invention, the following advantageous features are given.

First, since the essential parts of the switch are housed in a substantially hermetically sealed chamber, undesired freezing of the parts is prevented or at least minimized.

Second, since the rotary switch of the invention is so constructed as to forcedly convert a rotatable or swingable movement of a rotatable member (viz., the arm member 16 in FIG. 1 and the arm member 57 in FIG. 7) into ON-and-OFF motions of a rotatable contact (viz., the rotatable contact 22 in FIG. 1 and the rotable contact 60 in FIG. 6), the normal function of the switch is kept even when some parts thereof are somewhat iced in winter.

Third, since the switch can be assembled without using any adhesive material, manufacturing of the same is quite facilitated.

Fourth, if a silicone grease or the like is applied to the switch in the afore-mentioned manner, the freeze-proof property of the switch is much assured.

The present invention may be subject to many modifications and changes without departing from the spirit or essential characteristics thereof. The aforedescribed embodiments are therefore to be considered in all respects as illustrative and not restrictive of the scope of the present invention.

What is claimed is:

1. A rotary switch comprising:

a case constructed of insulating material and having a bottomed cylindrical bore formed therein, the bottom being formed with a circular recess;

a pair of conductive plates embedded in said case, each plate having one end exposed to said cylindrical bore to form a stationary contact and the other end exposed to the outside of said case;

a rotatable contact having two contact points formed thereon, said rotatable contact being rotatably received in said cylindrical bore in such a manner that the contact points are brought into contact with the stationary contacts of the conductive plates when said rotatable contact assumes a given angular position relative to said case, said rotatable contact being formed at its center with a substantially rectangular opening;

a first structure having one end portion passed through said substantially rectangular opening of said rotatable contact and rotatably received in said circular recess of said case, said one end portion of said first structure having a generally rectangular cross section which is matched with said rectangular opening of said rotatable contact thereby to achieve a splined connection therebetween; and a circular second structure having a center bore defined by an inner cylindrical surface of a conical lip member of said circular second structure, said second structure being sealingly and detachably received in a mouth portion of said cylindrical bore of said case while sealingly receiving the other end portion of said first structure in said center bore thereof, said inner cylindrical surface of said conical lip member being arranged to promote a sealing between said circular second structure and the other end portion of said first structure.

2. A rotary switch as claimed in claim 1, in which said stationary contacts are positioned on diametrically opposed portions of the bottom of said cylindrical bore of the case with respect to the center of said bottom.

3. A rotary switch as claimed in claim 2, in which said contact points of said rotatable contact are provided at diametrically opposed portions of the rotatable contact with respect to the center of the rotatable contact.

4. A rotary switch as claimed in claim 3, in which said conical lip member comprises an annular groove formed along the inner cylindrical surface of said central bore, said annular groove being filled with silicone grease.

5. A rotary switch as claimed in claim 4, in which said first structure is formed with a larger circular portion the diameter of which is slightly smaller than that of said cylindrical bore of the case, said larger circular portion being formed at its major flat portion with an annular groove for receiving therein silicone grease.

6. A rotary switch as claimed in claim 1, further comprising an annular washer which is interposed between said rotatable contact and said circular second structure for stably holding said second structure on the other end portion of said first structure.

7. A rotary switch as claimed in claim 1, in which said rotatable contact is constructed of resilient metal plate and axially deformed when no external force is applied thereto, so that upon assembly, said rotatable contact is axially compressed thereby causing said contact points thereof to be pressed against the bottom of the cylindrical bore of said case.

8. A rotary switch as claimed in claim 7, in which said rotatable contact comprises two generally J-shaped arms which extend outwardly from diametrically opposed portions of a central bored base portion of the rotatable contact, said contact points being provided at the leading ends of said arms respectively.

9. A rotary switch as claimed in claim 8, in which the other end portion of said first structure is integrally connected to a hub portion of an arm member which extends perpendicular to the longitudinal axis of said first structure.

10. A rotary switch as claimed in claim 7, in which said rotatable contact comprises a pair of arcuate wing portions which are integrally connected at their longitudinal ends with each other to form an annular peripheral portion, said contact points being provided at the integrally connected portions of said arcuate wing portions.

11. A rotary switch comprising:

a case constructed of insulating material and having a bottomed cylindrical bore formed therein, the bottom being formed with a circular recess;

a pair of conductive plates embedded in said case, each plate having one end exposed to said cylindrical bore to form a stationary contact and the other end exposed to the outside of said case;

a rotatable contact having two contact points formed thereon, said rotatable contact being rotatably received in said cylindrical bore in such a manner that the contact points are brought into contact with the stationary contacts of the conductive plates when said rotatable contact assumes a given angular position relative to said case, said rotatable contact being formed at its center with a generally rectangular opening;

a first structure having one end portion passed through said substantially rectangular opening of said rotatable contact and rotatably received in said circular recess of said case, said one end portion of said first structure having a generally rectangular cross section which is matched with said rectangular opening of said rotatable contact thereby to achieve a splined connection therebetween; and a circular second structure having a center bore, said second structure being sealingly and detachably received in a mouth portion of said cylindrical bore of said case while sealingly receiving the other end of said first structure in said center bore thereof, said center bore being formed around the inner cylindrical surface thereof an annular groove which is filled with silicone grease thereby to achieve a sealing between said circular second structure and the other end portion of said first structure.

12. A rotary switch as claimed in claim 11, in which said stationary contacts are positioned on diametrically opposed portions of the bottom of said cylindrical bore of the case with respect to the center of said bottom.

13. A rotary switch as claimed in claim 12, in which said contact points of said rotatable contact are provided at diametrically opposed portions of the rotatable contact with respect to the center of the rotatable contact.

14. A rotary switch as claimed in claim 11, in which said first structure is formed with a larger circular portion the diameter of which is slightly smaller than that of said cylindrical bore of the case, said larger circular portion being formed at its major flat portion with an annular groove for receiving therein silicone grease.

15. A rotary switch as claimed in claim 11, further comprising an annular washer which is interposed between said rotatable contact and said circular second structure for stably holding said second structure on the other end portion of said first structure.

16. A rotary switch as claimed in claim 11, in which said rotatable contact is constructed of resilient metal plate and axially deformed when no external force is applied thereto, so that upon assembly, said rotatable contact is axially compressed thereby causing said contact points thereof to be pressed against the bottom of the cylindrical bore of said case.

17. A rotary switch as claimed in claim 16, in which said rotatable contact comprises two generally J-shaped arms which extend outwardly from diametrically opposed portions of a central board base portion of the rotatable contact, said contact points being provided at the leading ends of said arms respectively.

18. A rotary switch as claimed in claim 17, in which the other end portion of said first structure is integrally connected to a hub portion of an arm member which extends perpendicular to the longitudinal axis of said first structure.

19. A rotary switch as claimed in claim 16, in which said rotatable contact comprises a pair of arcuate wing portions which are integrally connected at their longitudinal ends with each other to form an annular peripheral portion, said contact points being provided at the integrally connected portions of said arcuate wing portions.

* * * * *